US005544728A

United States Patent [19]

Dabrowski

[11] Patent Number: 5,544,728

[45] Date of Patent: Aug. 13, 1996

[54] RETROFIT BILL VALIDATOR ASSEMBLY

[76] Inventor: Stanley P. Dabrowski, 8068 W. Sahara Ave., Suite C, Las Vegas, Nev. 89117

[21] Appl. No.: 500,548

[22] Filed: Jul. 11, 1995

Related U.S. Application Data

[63] Continuation-in-part of Ser. No. 23,371, May 24, 1994, Pat. No. Des. 360,227, and a continuation-in-part of Ser. No. 23,391, May 24, 1994, and a continuation-in-part of Ser. No. 23,396, May 24, 1994, Pat. No. Des. 360,22.

[51] Int. Cl.[6] ..... G07F 7/04; G07F 9/10

[52] U.S. Cl. ..... 194/206; 194/350; 273/143 R

[58] Field of Search ..... 194/205, 206, 194/207, 216, 217, 218, 350; 273/142 R, 143 R

[56] References Cited

U.S. PATENT DOCUMENTS

| | | | |
|---|---|---|---|
| 4,669,596 | 6/1987 | Capers et al. | 194/217 X |
| 4,966,304 | 10/1990 | Kelly | 194/350 X |
| 5,102,136 | 4/1992 | Heidel et al. | 273/143 R |
| 5,113,990 | 5/1992 | Gabrius et al. | 194/206 |
| 5,209,477 | 5/1993 | Heidel et al. | 273/143 R |
| 5,310,035 | 5/1994 | Dobransky, Jr. et al. | 194/217 X |

FOREIGN PATENT DOCUMENTS

| | | | |
|---|---|---|---|
| 3641806 | 6/1988 | Germany | 194/206 |
| 3802124 | 8/1989 | Germany | 194/206 |
| 2186412 | 8/1987 | United Kingdom | 194/206 |
| 9321609 | 10/1993 | WIPO | 194/206 |

OTHER PUBLICATIONS

"The Dollars & Sense Solution", advertisement in Vending Times, Jul. 1989.

*Primary Examiner*—Karen B. Merritt
*Assistant Examiner*—Scott L. Lowe
*Attorney, Agent, or Firm*—John E. Roethel

[57] ABSTRACT

A bill validator assembly is provided that retrofits a coin and token only slot machine to be operable with paper currency. A replacement mounting plate relocates the slot reels and provides space for a bill validator and storage cassette on the interior of the slot machine. An improved stacking drive stacks the bills horizontally for storage within the cassette and minimizes currency jams.

2 Claims, 4 Drawing Sheets

RETROFIT BILL VALIDATOR ASSEMBLY

CROSS-REFERENCE TO RELATED APPLICATIONS

This application is a Continuation-in-Part of application Ser. No. 29/023,371, filed May 24, 1994, entitled "Bill validator Kit for a Gaming Machine", now Patent No D360,277; U.S. application Ser. No. 29/023,391, filed May 24, 1994, entitled "Mounting Plate for a Bill Validator Kit and Reel Assembly for a Gaming Machine", now pending; and U.S. application Ser. No. 29/023,396, filed May 24, 1994, entitled "Face Plate for a Bill Validator Kit for a Gaming Machine", now Patent No D360,228.

This invention relates to a bill validator assembly used in an electronic slot machine and more particularly to a bill validator assembly that can be retrofit into an electronic slot machine that does not presently accept paper currency.

BACKGROUND OF THE INVENTION

Electronic slot machines have been traditionally operated by the players who insert coins or gaming tokens to activate the slot machine. The coins or tokens enter into the gaming machine through a coin head on the door of the gaming machine and pass through a coin acceptor mechanism that determines whether the coin or token is valid for that machine. The coin or token then falls into a coin hopper mounted internally in the slot machine.

In recent years, slot machines have begun to be made with currency acceptors provided therein as original equipment by the slot machine manufacturers. This construction allows a player to insert paper currency into the slot machine to activate the slot machine for play. The insertion of the paper currency causes a credit meter to be incremented according to the value of the paper currency. The player then uses the credits accrued on the credit meter to play the slot machine. A visual display of the credits accrued is normally shown on a meter visible to the player.

However, there are a considerable number of slot machines currently in use that presently are configured to only accept coins or gaming tokens. In order to extend the useful life of these slot machines, there is a need to convert these coin and token only slot machines to slot machines that are also capable of accepting paper currency.

It is an object of the present invention to provide a retrofit bill validator assembly that can be used to retrofit existing coin and token only slot machines to provide the capability of accepting paper currency.

It is a feature of the present invention that a replacement mounting plate is provided to relocate the reels of the slot machine and thereby provide space on the interior of the slot machine for a bill validator unit. The bill validator unit is also mounted on the mounting plate with the face plate of the bill validator unit extending through the front of the slot machine so that it is accessible by the player. A bill stacking unit forms part of the bill validator assembly and stores paper currency in a cassette for later removal.

It is an advantage of the present invention that coin and token only slot machines can be converted to be operable using paper currency. The expense of conversion is minimal, it can be done on location at the gaming establishment and there is no need to return the slot machine to the manufacturer for retrofitting. The cost of the coin and token only slot machines plus the cost of the retrofit bill validator assembly is less than the cost of a new slot machine manufactured with a bill validator as original equipment therein.

SUMMARY OF THE INVENTION

A bill validator assembly is provided that retrofits a coin and token only slot machine to be operable with paper currency. A replacement mounting plate relocates the slot reels and provides space for a bill validator and storage cassette on the interior of the slot machine. An improved stacking drive stacks the bills horizontally for storage within the cassette and minimizes currency jams.

DETAILED DESCRIPTION OF THE PREFERRED EMBODIMENTS

Figure 1:
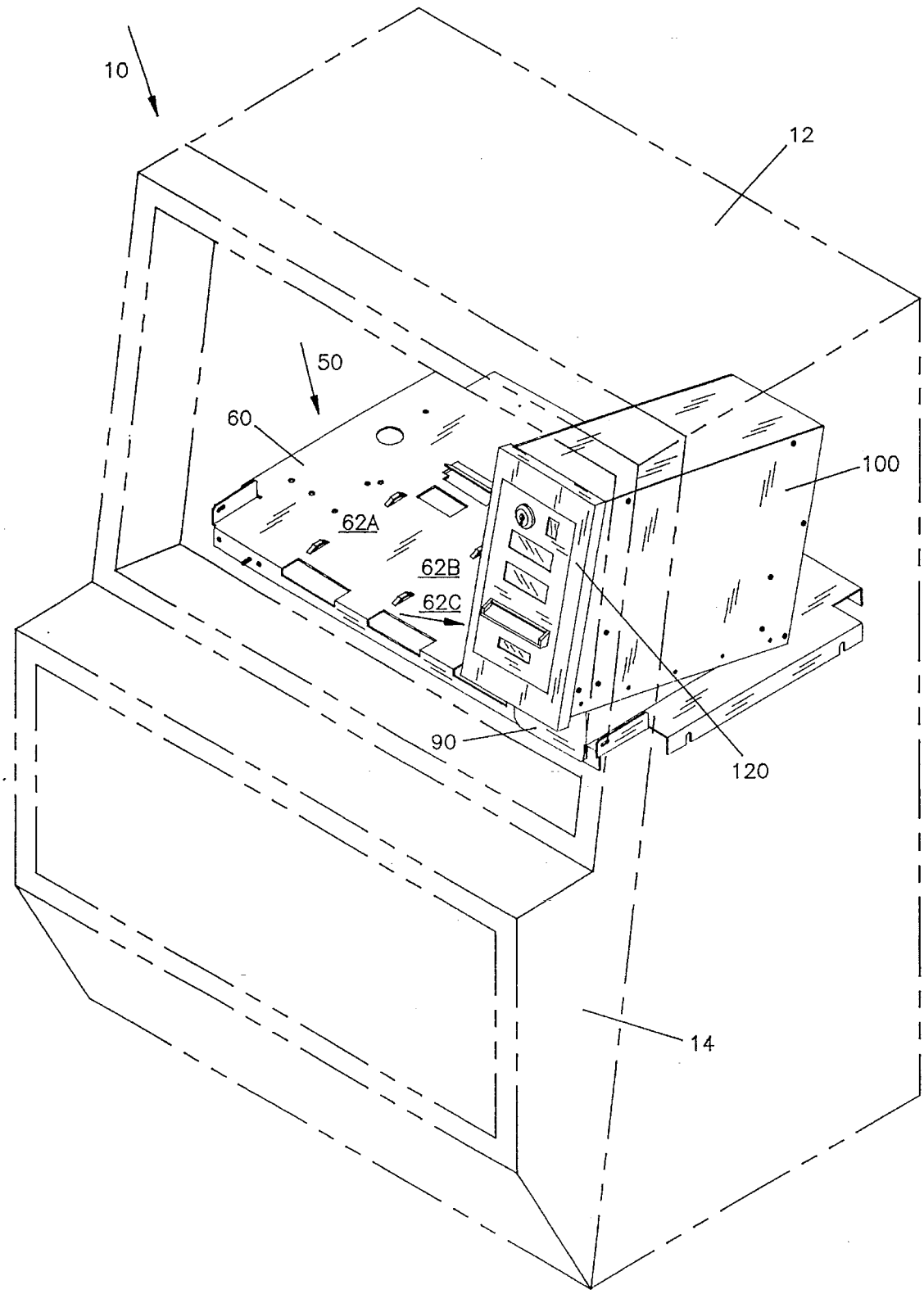
FIG. 1 is an isometric view of a slot machine fitted with the retrofit assembly of the present invention.
Figure 2:
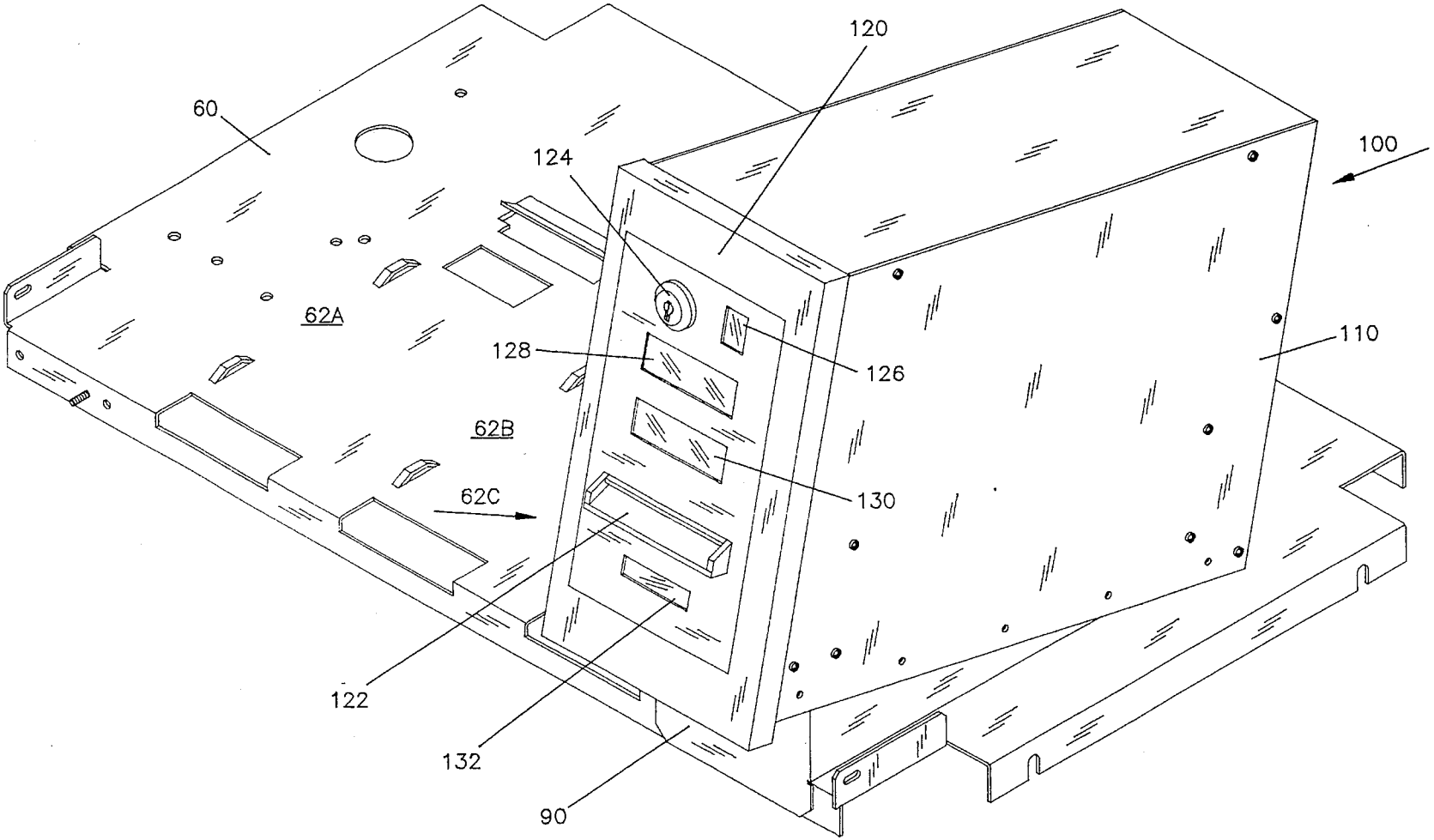
FIG. 2 is an isometric view of the retrofit assembly of the present invention.

A slot machine provided with the retrofit assembly of the present invention is shown generally at 10 in FIG. 1. A traditional slot machine has a cabinet 12 with a door 14 hinged thereto to provide access to the interior of the slot machine 10.

The retrofit assembly 50 of the present invention includes a replacement mounting plate 60 for the mounting plate that traditionally holds the mechanical assembly of the slot reels (not shown). The mounting plate 60 has three slot reel stations 62A, 62B and 62C.

The mounting plate 60 of the present invention has the same overall dimensions as the traditional mounting plate but the slot reel stations 62A, 62B and 62C are located laterally closer together and moved slightly to the left (as viewed facing the 10) to provide space on the interior of the slot machine 10 for the bill validator unit 100.

The bill validator unit 100 is fastened to the mounting plate 60 by means of a mounting bracket 90 at the front of the bill validator unit 100 and a plurality of screws or other fastening means (not shown) at the rear of the bill validator unit 100.

The bill validator unit 100 has an outer shell 110 that covers the internal components and a face plate 120 that extends through the upper glass area of the slot machine 10 when the retrofit assembly 50 is mounted in the slot machine 10 to make the bill validator unit 100 accessible to the player. The face plate 120 includes a bill insert shelf 122 into which paper currency is inserted by the player. A key lock 124 is provided to securely close the face plate 120 into the body of the bill validator unit 100. Various LED displays are also provided including a first display 126 that displays to the player the number of credits remaining, a second display 128, a third display 130 and a fourth display 132. Each of the second display 128, third display 130 and fourth display 132 are electronically connected to a electronic computer control that operates the bill validator unit 150 and the bill cassette 160 and these displays are used to show data or other information for use by the player or the gaming establishment during the operation and use of the slot machine 10.

Figure 3:
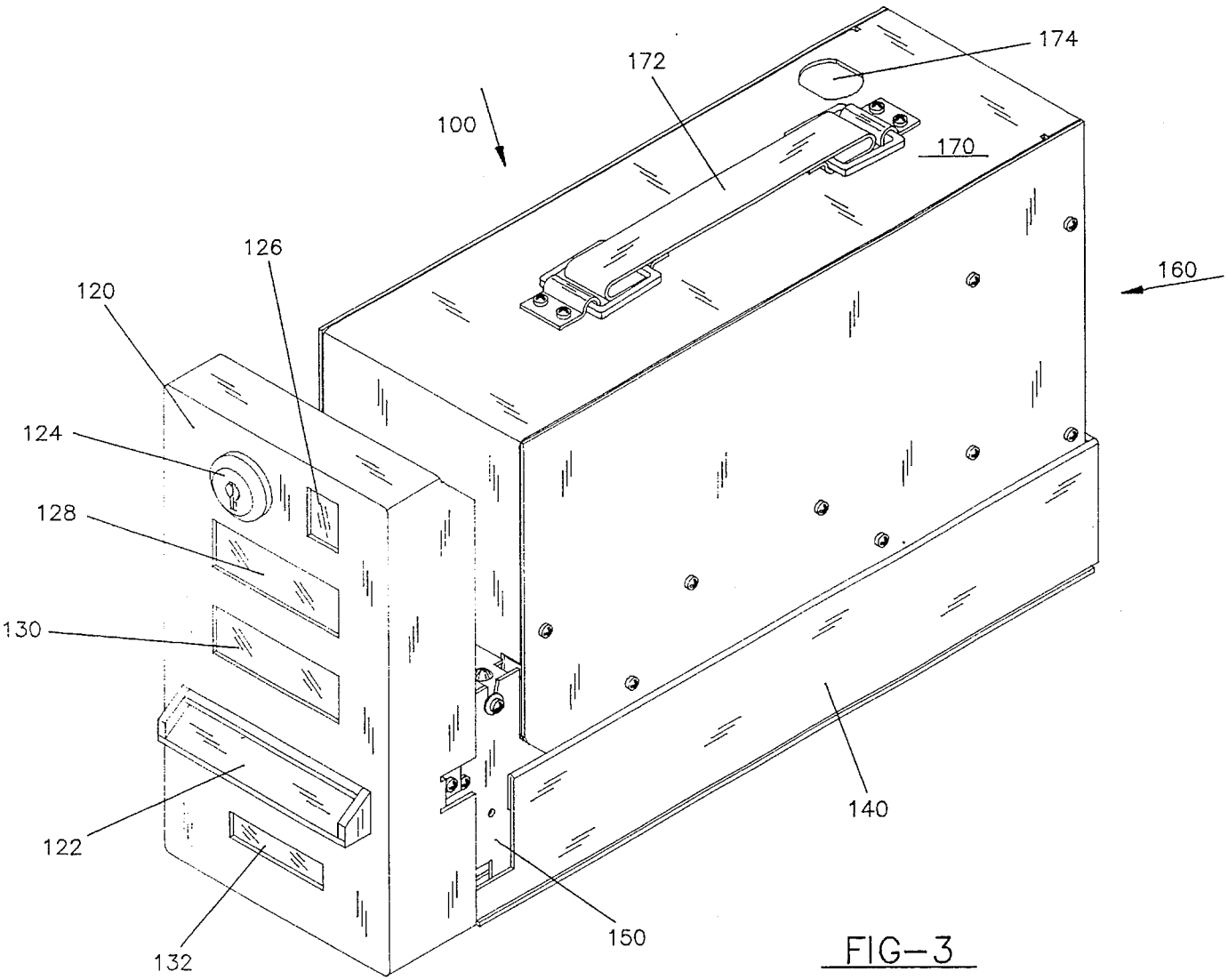
FIG. 3 is an isometric view of the bill validator unit of the present invention with its outer shell removed.

FIG. 3 shows the face plate 120 connected to the base 140 which receives the bill cassette 160. An electrical connection between the bill cassette 160 and the base 140 is provided by the pin connector 142 on the base 140. A corresponding pin connector (not shown) is mounted on the underside of the bill cassette 160. A conventional bill validator 150 is positioned on the base 140 directly behind the face plate 120 and in alignment with the bill insert shelf 122.

Figure 4:
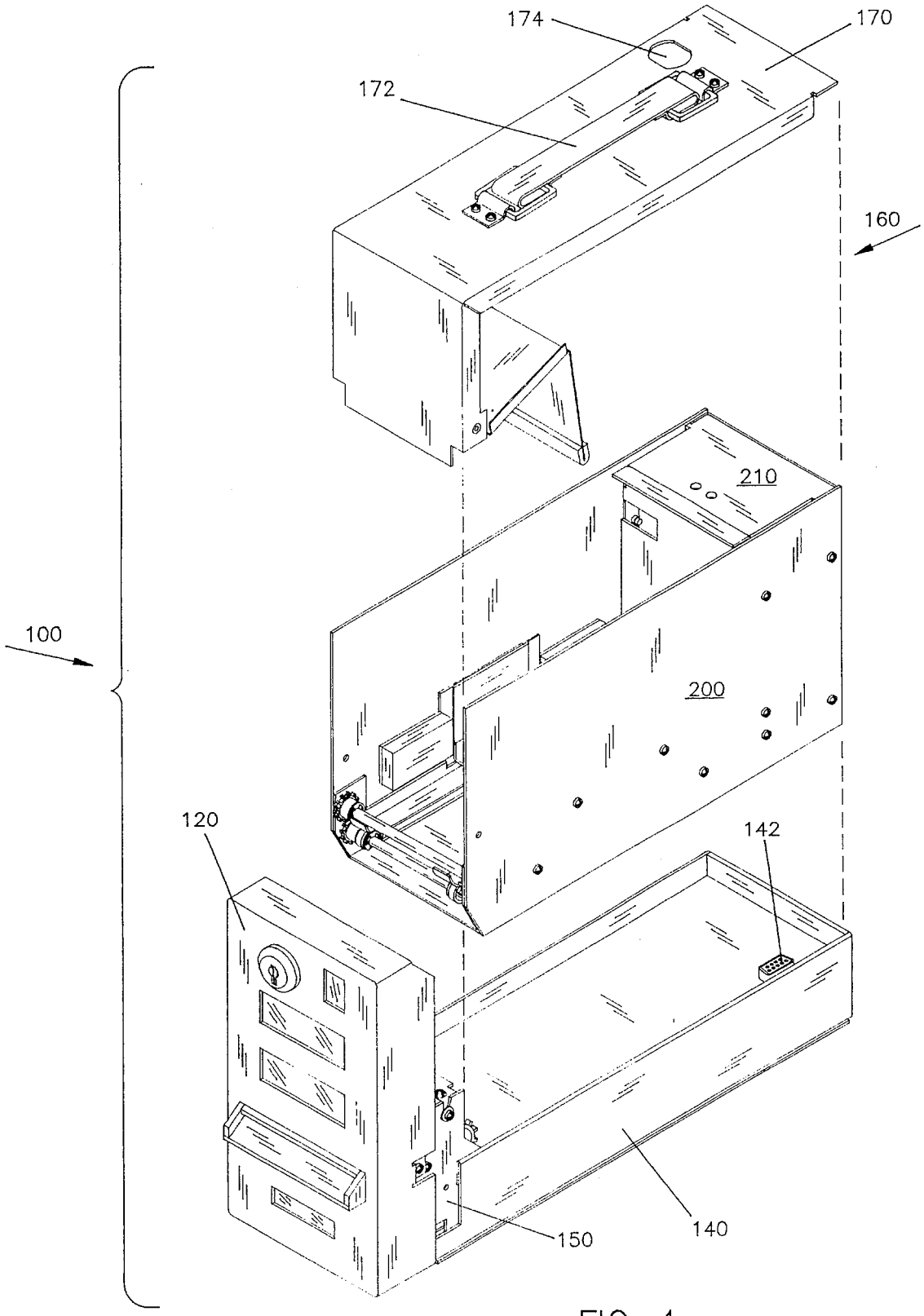
FIG. 4 is an exploded view of the bill validator unit of the present invention with its outer shell removed.

FIG. 4 shows the bill cassette 160 in an exploded view. The bill cassette 160 comprises a cassette body 200 that is generally hollow to provide a space for the paper currency to be stacked following insertion into the bill insert shelf 122 and acceptance by the bill validator 150. At the rear of the cassette body 200 is a stacker drive housing 210 that contains the mechanical elements that effect the stacking of the paper currency.

The top of the cassette body 200 is closed by a cassette lid 170 that is hingedly connected to the cassette body 200. The cassette lid 170 also includes a handle 172 and a lock aperture 174 for locking the cassette lid 170 into a securely closed condition.

In operation, the owner of a conventional coin and token only slot machine obtains a retrofit assembly 50 that is used to convert the slot machine 10 into a paper currency accepting slot machine. The old mounting plate in the existing slot machine is removed and the new mounting plate 60 is inserted in its place. The reel structure is then remounted onto the new mounting plate 60 with each of the three reels fastened or otherwise secured to the mounting plate at 62A, 62B and 62C respectively. This results in the reels being moved slightly to the left (as viewed facing the slot machine 10) and slightly closer together. The bill validator unit 100 is fastened to the mounting plate 60 by means of the mounting bracket 90 and other fastening means.

A new piece of glass is also provided in the upper area of the slot machine 10 to allow the face plate 120 to extend out the front of the slot machine 10 so that the bill validator unit 100 is accessible by the player. The new glass in the upper area of the slot machine 10 may also contain printing or other distinctive markings identifying the reels behind the glass and providing other information about the method of operation of the slot machine 10.

In use, the player inserts paper currency into the bill insert shelf 122 and the paper currency is drawn into the bill validator 150 for validation. If the paper currency is found to be valid, the paper currency is further drawn into the bill cassette 160 where it is appropriately stacked by the stacker drive housing 210 in the cassette body 200.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

What is claimed is:

1. A bill validator assembly for use as a conversion assembly for converting a coin and token only slot machine into a slot machine that can also accept paper currency comprising:

a) a mounting plate having a plurality of slot reel stations positioned thereon in close proximity to one another so as to provide sufficient space in the interior of the slot machine to receive a bill validator unit therein;

b) a bill validator unit mounted on the mounting plate adjacent to the slot reel stations;

c) the bill validator unit comprising:

1) a face plate having a bill insert shelf and a first display for showing any accrued credits;

2) a bill validator mounted behind the face plate for validating currency inserted through the bill insert shelf; and 3) a bill cassette mounted to a base and positioned behind the bill validator for stacking and storing currency which has been validated.

2. A method of converting a slot machine that accepts only coins or tokens into a slot machine that accepts not only coins and tokens but also paper currency comprising:

a) providing a retrofit mounting plate having a plurality of slot reel stations positioned thereon in close proximity to one another so as to provide sufficient space in the interior of the slot machine to receive a bill validator unit therein;

b) removing an existing mounting plate from the slot machine and replacing it with the retrofit mounting plate;

c) providing a bill validator unit comprising:

1) a face plate having a bill insert shelf and a first display for showing any accrued credits;

2) a bill validator mounted behind the face plate for validating currency inserted through the bill insert shelf, and 3) a bill cassette mounted to a base and positioned behind the bill validator for stacking and storing currency which has been validated; and d) mounting the bill validator unit on the retrofit mounting plate adjacent to the slot reel stations.

* * * * *